United States Patent [19]

Singelmann et al.

[11] 4,099,445

[45] Jul. 11, 1978

[54] PRESSURE DIFFERENTIAL PISTON-COMBUSTION CHAMBER SYSTEM

[75] Inventors: Dietrich Singelmann, Ottobrunn; Heinrich Strobl, Munich; German Munding, Bad Friedrichshall, all of Germany

[73] Assignee: Messerschmitt-Bolkow-Blohm GmbH, Munich, Germany

[21] Appl. No.: 862,637

[22] Filed: Sep. 22, 1969

[30] Foreign Application Priority Data

Aug. 21, 1968 [DE] Fed. Rep. of Germany ..... 1728077

[51] Int. Cl.[2] ..... F41F 1/04

[52] U.S. Cl. ..... 89/7; 89/8

[58] Field of Search ..... 60/26.1; 89/1, 7, 8

[56] References Cited

U.S. PATENT DOCUMENTS

| | | | |
|---|---|---|---|
| 2,981,153 | 4/1961 | Wilson, Jr. et al | 89/7 |
| 2,986,072 | 5/1961 | Hudson | 89/7 |
| 3,138,990 | 6/1964 | Jukes et al. | 89/7 |

*Primary Examiner*—David H. Brown
*Attorney, Agent, or Firm*—Toren, McGeady and Stanger

[57] ABSTRACT

A propelling or driving force generating system for propelling a device such as projectile in a fire arm comprises a combustion chamber cylinder formed at the end of a barrel containing a bore for the passage of a projectile and in which is movable in pressure differential piston. The piston includes an annular ring portion having surfaces on respectively axially opposite ends which are exposed to pressure forces existing in intermediate chambers defined between these surfaces and end walls of the surrounding cylinder in widened annular portions of the cylinder. The cylinder and piston are provided with one or more passages for the passage of a propellant component into the combustion chamber. The various propellant components which are preferably of a nature such that they will react hypergolically, are connected through valve means in these passages and by a central plunger element of said valve means into the combustion chamber. Reaction of the components generates combustion gases in the combustion chamber to force the piston backwardly in a working stroke and to produce a force for expelling the projectile through the bore at the opposite end of the combustion chamber. The construction is characterized by an arrangement which provides an additional moving force on the piston in order to aid its working stroke movement at the initial stage of such movement.

10 Claims, 3 Drawing Figures

Fig. 2
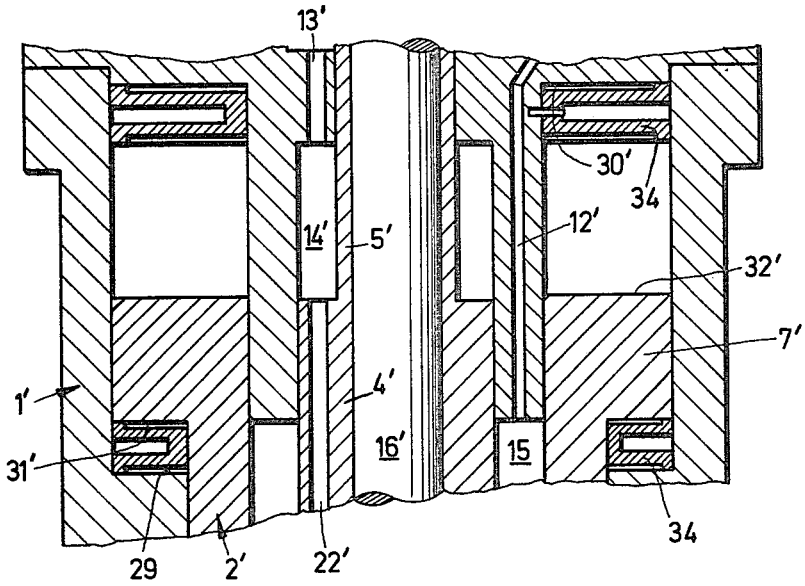
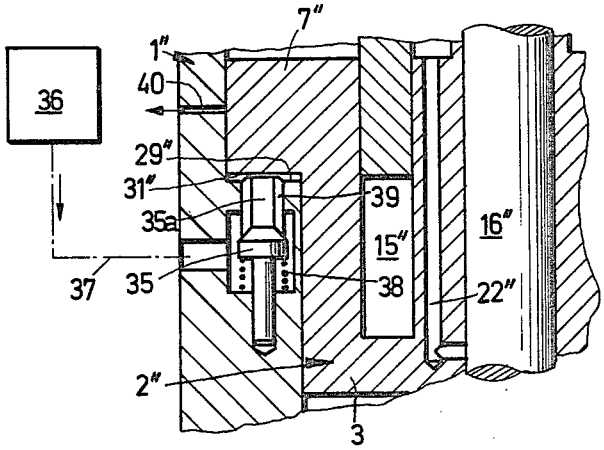
Fig. 3

PRESSURE DIFFERENTIAL PISTON-COMBUSTION CHAMBER SYSTEM

SUMMARY OF THE INVENTION

This invention relates in general to the construction of a driving force generating system and in particular to a new and useful device for producing a driving force for propelling projectiles, such as in a fire arms, and which includes a moving pressure differential piston which is moved by the force of gases generated in a combustion chamber and which is also aided in its movement by an additional force.

The present invention is particularly concerned with the production of a pressure differential piston combustion-chamber system for the production of propelling gases from liquid propellant components, particularly hypergolically reactive components, and particularly for use in propelling a projectile from a fire arm. The system of the invention has a guide cylinder for the pressure differential piston which forms a combustion chamber casing. The front end face of the piston closes an inner space of the combustion chamber and the opposite end forms together with parts, which are stationary or fast on the casing, distribution chambers for the propellant components. A projecting annular ring portion of the piston moves in an annular widened passage of the cylinder and the forward and return movement of the piston are aided by the pressure forces acting on each end of the piston ring portion. The pistion is urged backwardly during the combustion in the combustion chamber by the combustion chamber gas pressures and while so doing it creates an injection pressure for feeding the fuel components into the combustion chamber.

U.S. Pat. No. 3,138,990, discloses a rapid fire weapon which is actuated by a pressure differential piston-combustion chamber system. In this weapon the pressure gases which propel the projectile out of the barrel are produced in the combustion chamber by means of two liquid fuel components which react hypergolically with each other. In such a construction the injection of the fuel is initiated at the front reversing point of the pressure differential piston and a partial amount of the two fuel components is first conveyed or injected into the front region of the combustion chamber by means of the fuel container pressures. Due to the reaction of the propellant components a combustion pressure builds up at this location and acts against the front of the piston and annular end sides of the pressure differential piston and moves the piston back after having overcome an initial counterforce which is caused by a pressure medium. In so doing the previously injection quantities of propellant components are put under pressure by ring members of the pressure differential piston in annular spaces or distribution chambers and they are injected into the combustion chamber. At the same time, check valves or non-return valves automatically close in a direction toward the fuel containers or supply tanks. Since the front annular end face which faces the inner space of the combustion chamber is larger than the end face of the two ring members which press on the quantities of propellant components, a differential action sets in whereby the injection pressure at any given moment is larger than the respective inner pressure of the combustion chamber.

In order to obtain a favorable inner ballistic condition it is, according to a theory of shooting, necessary that pressure gases which are produced by combustion of an amount of gun powder which is weighed into cartridges used in a conventional fire arm and which pressure gases drive the projectile out of the barrel, react at a high starting pressure in order to impart the projectile with a large initial acceleration and thus a high muzzle speed. It is true that the known fire arms which operate on the pressure differential combustion chamber principle for producing high pressure gases have certain advantages such as the saving of cartridges, less weight and less sensitivity of the used propellants. However, the known fire arms which operate on this principle have a disadvantage in respect to large initial acceleration and muzzle speed. This is true because in the initial stage of the inner ballistic procedure, that is, in the front reversing position of the pressure differential piston, the injection pressure energy which is produced will be merely that of the relatively low fuel supply container pressure. This causes a relatively flat rise of the pressure as indicated in the pressure-path diagram or in the inner ballistic work diagram. The pressure peak which is determinitive for a large initial acceleration of the projectile is obtained too late and with a loss of time in the form of an undesired staying period and only after the combustion chamber pressure starts operating and the increase of the injected propellants take place as a result thereof.

The present invention overcomes the disadvantages of the prior art by providing a driving force generating system in which the propelling gases have a steep pressure increase in respect to their pressure path diagrams so that they are made suitable for fields of utilization which require such steep pressure increase particularly for fire arms. With the invention the pressure differential piston is driven at the beginning of its working stroke during the initial phase of its movement by means of a special additional moving force. This additional moving force is active when the combustion chamber pressure has not achieved a sufficiently high driving force value and when a very large amount of propellant is injected into the combustion chamber. This produces an extremely large build-up of the combustion chamber pressure to initiate the backward movement of the pressure differential piston.

In accordance with one feature of the invention the additional driving force is provided by utilizing the kinetic energy of the forward moving pressure differential piston. This is effected by providing a gas spring or mechanical spring action on the piston so that for example the spring, or its force, is increased or tensioned by the retreating movement of the piston and will react on the piston to create an initial driving force in a working direction.

In a further embodiment of the invention, the additional driving force is obtained by the use of an extraneous pressure source which is obtained, for example, by connecting the cylinder to a storage tank of a gas such as air which is maintained under pressure. One or more pressure supply valves may be built into the combustion chamber casing in the region adjacent the annular ring portion of the pressure differential piston. Such valves are provided with sensing means which project into the path of the piston and are contacted during the return movement of the piston to supply the gas under pressure against a face of the piston to move it in an opposite direction in a working stroke. A similar arrangement may be employed at each end of the piston stroke in order to facilitate both the working stroke and the return stroke.

Accordingly, it is an object of the invention to provide improved driving force generating system for propelling a device such as a projectile which includes a differential pressure piston which is movable in the cylinder formed at the end of a barrel having a bore for the movement of a projectile therethrough, for example, and wherein the piston is moved backwardly in a working stroke by the forces of gases generated within the combustion chamber and fed into the chamber by the movement of the piston, and wherein an additional force acts on the piston during the initial portion of its working stroke in order to move it more rapidly during this portion.

A further object of the invention is to provide a fire arm device which includes a combustion chamber for the end of the barrel having a bore for the passage of a projectile therethrough, and which includes a pressure differential piston which is slidable in the combustion chamber, the combustion chamber having means for injecting propellant components therein preferably components which react hypergolically, and wherein the piston includes a widened ring portion having respectively opposite directed axially spaced end faces which are acted upon by additional force means such as a spring or a gas under pressure to move it during an initial period in each direction of movement and particularly for effecting a steep pressure increase in the combustion chamber in order to make the propellant producible therein suitable for use in driving a projectile.

A further object of the invention is to provide a driving force generating system which is simple in design, rugged in construction and economical to manufacture.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 2 is a partial sectional view similar to that indicated in FIG. 1 of another embodiment of the invention; and FIG. 3 is a partial sectional view similar to FIG. 1 of still another embodiment of the invention.

GENERAL DESCRIPTION OF THE PREFERRED EMBODIMENTS

Figure 1:
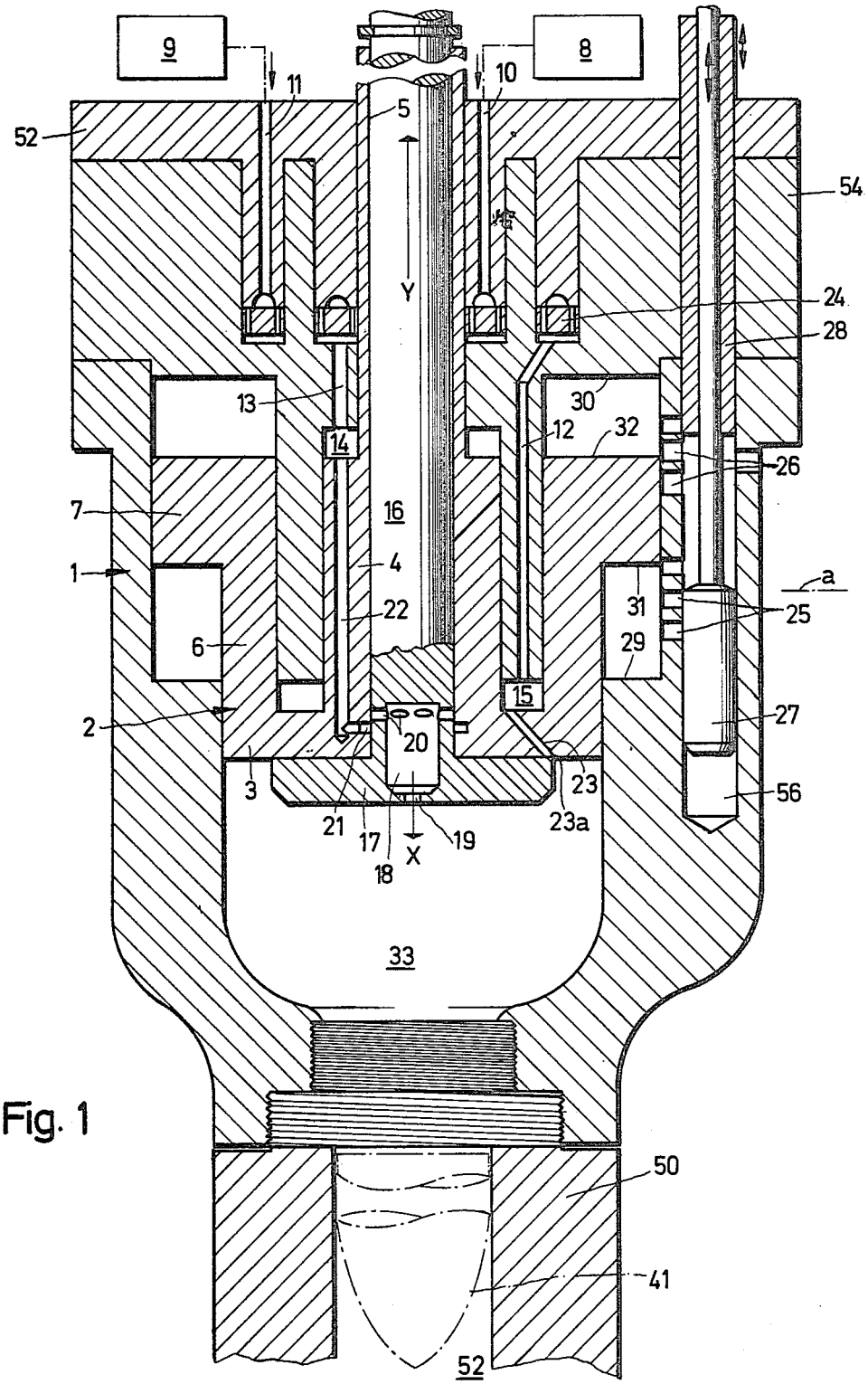
FIG. 1 is a longitudinal sectional view of a driving force generating system constructed in accordance with the invention.

Referring to the drawings in particular the invention embodied therein as indicated in FIG. 1, comprises a pressure differential piston generally designated 2 which slides in a cylinder or combustion chamber casing generally designated 1. The piston 2 includes a central piston portion having a front face 3 which extends into a combustion chamber 33 which, in the embodiment illustrated, is formed at the end of a projectile barrel 50 having a passage 52 therethrough for the passage of a projectile 41.

The piston 2 includes an elongated inner piston part 4 having a bore defining a guide for valve means which includes a plunger 16 and plate valves 24. The piston 2 also includes a central cylindrical piston portion 6 which slides in the combustion chamber 33 and which has at its trailing or rear end a widened annular portion or ring 7.

Two propellant components such as an oxygen and a liquid fuel are stored in supply containers or tanks 8 and 9, respectively and they are connected through axially elongated passages 10 and 11 defined in an end plate 52 which is secured over an end cylinder wall 54. The inner or lower end of the passages 10 and 11 communicate to annular spaces having valve means in the form of individual plate valves 24. The inner annular passage which communicates with the elongated passage 10 for the oxygen communicates through the valve means to an axially elongated passage 13 terminating in an annular distribution chamber or pump chamber 14 defined between the cylinder end wall 54 and the piston interior portion 4. The outer annular passage which communicates with the liquid fuel being delivered through the passage 11 from the supply tank 9 communicates with an elongated passage 12 which terminates in the annular distribution passage or pump chamber 15 defined between the piston portion 4 and the cylinder end wall 54. The distribution passage 14 for the oxygen communicates with the elongated passage 22 which leads through a tangential passage 21 into tangential passages 20 defined around the interior of a swirl chamber 18 defined at the head portion of the plunger 16. The oxygen which is introduced into the swirl chamber 18 will be directed downwardly through a discharge nozzle 19. The liquid fuel on the other hand will move through the passage 12 and the distribution passage 15 and an inclined passage 33 through a discharge nozzle **23*a* which is normally covered by the head portion 17 of the plunger 16 but which is uncovered by the head portion when the piston begins movement in its working stroke by the forces of inertia which act. In a similar manner the passages 20 communicate with the annular supply duct 21 when the plunger 16 is moved because of inertia away from the associated piston 2. The plunger 16 is under the action of a return spring (not shown) which urges it in a direction of the arrow Y against the face 3 of the piston 2. In the position indicated in FIG. 1 the tangential bores 20 are out of alignment with the annular passage 21 so that the supply of the propellant component is blocked. Instead of the plate valves 24**, check valves or non-return valves may be employed.

In accordance with the embodiment of the invention indicated in FIG. 1, means are provided to generate a moving force which acts on the piston 2 to drive the piston during an initial phase of its workings stroke and also preferably during an initial phase of its return stroke. In this embodiment, a control mechanism for acting on the respective surfaces 31 and 32 of the ring portion 7 of the piston 2 during the respective initial portions of the driving and return strokes is actuated to provide a fluid pressure driving force on these surfaces at selected stages of the movement of the piston. For this purpose control bores 25, 25 and 26,26 are in communication with a free air space and either partially cleared or blocked by means of a control piston 27 which moves in an axially defined chamber 56 of the cylinder wall 1. The additional pressure is applied in the space between the surface 31 and the boundary surface 29 to move the piston 1 in the working direction and between the surface 30 and the surface 32 to move the piston in a return direction. This additional pressure force is provided at the reversing points of the forward and rearward movement of the piston 2 and is effected under the control of the control piston 27.

The operation of the device indicated in FIG. 1 is a follows:

In FIG. 1, it is assumed that the pressure differential piston 2 which is located in about its central position has started to move forward in the return movement in the direction of the arrow X. Because of the position of the control piston 27, the two front control bores 25 are covered and thus the forwardly moving differential piston 2 compresses, by the annular portion 7, the air which is enclosed or included between the surfaces 31 and 29. A counterforce is thus created in this manner which causes the pressure differential piston 2 to come to rest or to stand still at the bottom of its return movement. This compressed air amounts to a tensioned gas spring which releases its stored energy immediately to the pressure differential piston 2 and thus moves the piston back in the direction of the arrow Y during the initial phase of the working stroke of the piston. In so doing the inner space of the annular pump chambers 14 and 15 becomes smaller so that a partial amount of the two propellant components such as oxygen carrier and fuel is injected into the combustion chamber as the plunger 16 with its head portion 17 is moved to the opened position through its own mass inertia force brought about the rapid movement of the piston 2 in a working direction.

The partial amounts of the two propellant components which are injected into the combustion space 33 by the additional force of the gas spring react in a hypergolic manner. When the combustion process starts, the pressure of the combustion space 33 acts on the pressure differential piston 2 to cause an additional injection of the additional remaining amount of the two propellant components into the distribution chambers 14 and 15. In order to dampen the rearward movement of the pressure differential piston 2 for the initial acceleration in a return movement a certain amount of air is compressed in the space defined between the surfaces 30 and 32 by the annular piston portion 7. The volume of this air is determined by the respective positions of the control sleeve 28. As a further driving force for the pressure differential piston 2, there is the pressure which prevails in the two propellant containers 8 and 9.

In the embodiment indicated in FIG. 2, similar parts are similarly designated but with a prime and in respect to a pressure differential piston 2' which is movable within the cylinder 1'. An annular spring 34 is arranged between the front end boundary surface 29' and the countersurface 31' as well as between the surface 30' and the rear surface 32'. These annular springs 34, 34 give off their stored energy during the reversal of the pressure differential piston 2 at the beginning of the working stroke and also at the beginning of the return stroke.

In the embodiment illustrated in FIG. 3, similar parts are again similar designated but with the addition of two primes. In this embodiment several pressure gas supply valves 35 in the form of controlled non-return, or check valves are disposed in the cylinder wall 1'' at a location to project into the space between the surfaces 29'' and 31''. Each valve includes a sensing pin **35*a* which projects into the path of the moving piston 2'' and it is displaced by the piston to open the valve and communicate the space between the surfaces 29'' and 31'' with a source of gas under pressure through a connecting line 37 and a supply tank 36. The pressure air extends through grooves 39 of the valves and into the space to brake the movement of the pressure differential piston 2 at the end of its return movement and to accelerate the piston at the beginning or at the initial phase of its working stroke movement. After the piston 2 moves away from the sensing valve 35, the valve is then again closed by spring 38. After this the piston uncovers a bore 40 which vents through the cylinder 1'' as indicated. In the meantime a sufficient combustion pressure is built up in the combustion chamber space 33 as indicated in FIG. 1 and the gases which are formed due to combustion drive the projectile 41 through the passage 52. The driving of the projectile is in an outward direction in accordance with the laws of inner ballistics. The piston 2 is moved into a starting position under the urging of a spring (not shown) which acts on the plunger 16** in the direction of the arrow Y.

What is claimed is:

1. A driving force generating system for propelling a device such as a projectile particularly in a fire arm, comprising wall means defining a combustion chamber, a piston movable in said combustion chamber, propellant component passage means defined in said wall means for delivering propellant components into said combustion chamber, valve means associated with said passage means permitting flow of said propellant components through said passage means into said combustion chamber, said propellant components being reactable in said combustion chamber to move said piston in a working stroke, a force accumulator connected to said piston and being responsive to movement of said piston to accumulate a drive force, and control means for causing said drive force to act on said piston at the beginning of its movement in its working stroke to aid in such movement.

2. A driving force generating system, according to claim 1, wherein said force accumulator includes a spring means acting on said piston.

3. A driving force generating system, according to claim 1, wherein said force accumulator comprises a chamber connected to said combustion chamber and being pressurized by the kinetic energy of the movement of said piston, said control means comprising a passage for connecting said chamber to communicate the stored pressure to said piston to aid it in its movement at the beginning of its working stroke.

4. A driving force generating system for propelling a device such as a projectile particularly in a fire arm, comprising wall means defining a combustion chamber, a piston movable in said combustion chamber, propellant component passage means defined in said wall means for delivering propellant components into said combustion chamber, valve means associated with said passage means permitting flow of said propellant components through said passage means into said combustion chamber, said propellant components being reactable in said combustion chamber to move said piston in a working stroke, and additional force means acting on said piston at the beginning of its movement in its working stroke to aid in such movement, wherein said piston has a central piston portion slidable in said combustion chamber and an annular ring portion of increased dimension, said combustion chamber having an increased dimension portion in which said ring portion is movable, the space in said combustion chamber of increased dimension defining a fluid pressure storage chamber acting on each end of the ring portions of said piston and providing means for breaking the movement of said piston in a working direction and in a return direction and for providing a moving force for said piston in the initial stages of movement in its working direction and in the initial stages of movement in a return direction.

5. A driving force generating system, according to claim 4, including spring means disposed in the path of movement of said ring portion of said piston and acting on said ring portion to aid in its movement during initial portion of movement of its working stroke.

6. A driving force generating system, according to claim 4, including a control chamber connected to said cylinder and respective opposite sides of said ring portion of said piston, and a control piston slidable in said control chamber, said control chamber having openings at spaced locations which are covered and uncovered by movement of said piston for regulating the movement of the air by movement of said ring portion of said piston for aiding the movement of said piston in its initial portion of movement in its working stroke direction.

7. A driving force generating system for propelling a device such as a projectile particularly in a fire arm, comprising wall means defining a combustion chamber, a piston movable in said combustion chamber, propellant component passage means defined in said wall means for delivering propellant components into said combustion chamber, valve means associated with said passage means permitting flow of said propellant components through said passage means into said combustion chamber, said propellant components being reactable in said combustion chamber to move said piston in a working stroke, and additional force means acting on said piston at the beginning of its movement in its working stroke to aid in such movement, said additional force means comprising an annular spring surrounding said piston, said piston having an annular portion projecting outwardly from the sides thereof and engageable with said spring at the end of the path of movement thereof in a return direction.

8. A driving force generating system for propelling a device such as a projectile particularly in a fire arm, comprising wall means defining a combustion chamber, a piston movable in said combustion chamber, propellant component passage means defined in said wall means for delivering propellant components into said combustion chamber, valve means associated with said passage means permitting flow of propellant components through said passage means into said combustion chamber, said propellant components being reactable in said combustion chamber to move said piston in a working stroke, additional force means acting on said piston at the beginning of its movement in its working stroke to aid in such movement, said additional force means comprising a valve projecting into said wall means, said wall means including a widened wall portion, said piston having an annular ring portion of increased dimension slidable in said widened wall portion of said wall means, said valve being oriented to project into the path of movement of said ring portion of said piston and being located to open just prior to the end of the return movement of said ring portion of said piston, and means connected to said valve for supplying compressed gas through said valve when opened by said piston and into said combustion chamber to act on said ring portion to move said ring portion with said piston in a working direction.

9. A driving force generating system for propelling a projectile in a fire arm, comprising a tubular member defining a projectile bore passage and a widened combustion chamber at the end of said passage, a piston having a central portion slidable in said combustion chamber and having a widened ring portion, said tubular member having a widened portion permitting axial movement of the ring portion of said piston, propellant supply tank means, pump means connected between said propellant supply tank means and said combustion chamber and being movable by movement of said piston to pump propellant components to said combustion chamber for generating gaseous products of combustion therein and for effecting a working stroke of said piston in a direction away from said projectile passage, a force accumulator connected to said pistion and being responsive to movement of said piston to accumulate a drive force, and control means for causing said accumulated drive force to act on said piston during the initial stage of movement thereof in its working stroke.

10. A driving force generating system, according to claim 9, wherein said pump means includes an end plate closing said tubular member and having a plurality of passages defined therein, said passages and extending through said piston, and valve means associated with said passages including a plunger slidable in said piston and being movable away from said piston by inertia during the movement of said piston in a working stroke to open said passages.

* * * * *